US008967568B2

(12) United States Patent
Wills et al.

(10) Patent No.: US 8,967,568 B2
(45) Date of Patent: Mar. 3, 2015

(54) ADJUSTABLE ROLLER SHADE BRACKET

(75) Inventors: Norman Wills, Mississauga (CA); Philip Ng, Thornhill (CA)

(73) Assignee: ZMC Metal Coating Inc., Woodbridge (CA)

( * ) Notice: Subject to any disclaimer, the term of this patent is extended or adjusted under 35 U.S.C. 154(b) by 687 days.

(21) Appl. No.: 13/236,207

(22) Filed: Sep. 19, 2011

(65) Prior Publication Data

US 2013/0068904 A1 Mar. 21, 2013

(51) Int. Cl.
*A47H 1/10* (2006.01)
*E06B 9/50* (2006.01)

(52) U.S. Cl.
CPC ..... *E06B 9/50* (2013.01)
USPC ..... 248/269; 248/267; 160/323.1

(58) Field of Classification Search
CPC ..... A47H 1/13; A47H 1/14; E06B 5/00; E06B 9/40; E06B 9/44
USPC ..... 248/254, 258, 262, 267, 268, 269; 160/120, 321, 323.1; 211/117, 123
See application file for complete search history.

(56) References Cited

U.S. PATENT DOCUMENTS

| | | | | |
|---|---|---|---|---|
| 327,839 | A | 10/1885 | Van Kirk | |
| 438,190 | A | 10/1890 | Schlueter | |
| 544,899 | A | 8/1895 | Mohr | |
| 705,339 | A | 7/1902 | Giorgio | |
| 738,720 | A | 9/1903 | Gerth | |
| 829,891 | A | 8/1906 | Reynolds | |
| 838,181 | A | 12/1906 | Grippin | |
| 1,227,194 | A | 5/1917 | Peterson | |
| 1,236,269 | A | 8/1917 | Cole | |
| 1,346,233 | A | 7/1920 | Mikolyn | |
| 1,437,851 | A | 12/1922 | Lange | |
| 1,451,947 | A | 4/1923 | Gugliuzzi | |
| 1,499,340 | A | 7/1924 | Bundy | |
| 2,013,500 | A | 9/1935 | O'Connor | |
| 2,371,903 | A | 3/1945 | Maier | |
| 2,480,438 | A | 8/1949 | Bergman | |
| 2,894,710 | A | 7/1959 | Shields | |
| 3,730,469 | A | 5/1973 | Shields | |
| 4,270,720 | A * | 6/1981 | Fukuchi | 248/269 |
| 4,363,459 | A | 12/1982 | Holzer | |
| 5,044,589 | A | 9/1991 | Milne et al. | |
| 5,083,601 | A * | 1/1992 | Tedeschi | 160/323.1 |
| 5,899,424 | A | 5/1999 | Williams, Jr. | |
| 6,196,508 | B1 | 3/2001 | Nijs | |
| 6,935,401 | B2 * | 8/2005 | Fraczek et al. | 160/321 |
| 7,451,956 | B2 | 11/2008 | Bohlen | |
| 7,677,294 | B2 * | 3/2010 | Bohlen | 160/323.1 |
| 7,854,419 | B2 | 12/2010 | Ng et al. | |
| 8,122,932 | B2 * | 2/2012 | Cannaverde | 160/120 |
| 8,151,859 | B2 * | 4/2012 | Koop et al. | 160/325 |
| 8,608,126 | B2 * | 12/2013 | Ng et al. | 248/636 |

* cited by examiner

*Primary Examiner* — Gwendolyn Baxter
(74) *Attorney, Agent, or Firm* — Honigman Miller Schwartz and Cohn LLP

(57) ABSTRACT

An adjustable roller shade bracket comprising a first plate, a second plate and a bracket member. The bracket member is adapted for mounting to a surface. The second plate is rotationally secured to the bracket member. The first plate is releasably securable to an end of a roller tube of a roller shade and slidably secured to the second plate such that the first plate may be slid along the second plate in a first plane. Rotation of the second plate about the bracket member through 90 degrees permits the first plate to be slid along the second plate in a plane perpendicular to the first plane.

7 Claims, 8 Drawing Sheets

ADJUSTABLE ROLLER SHADE BRACKET

FIELD

This invention relates generally to the field of brackets used to mount roller shades and other similar types of window coverings, and in particular to a new and unique adjustable roller shade bracket.

BACKGROUND

Roller shades, or blinds as they are sometimes referred to, are common forms of window coverings used in residential and commercial applications. Roller shades are typically mounted within or exterior to a window frame by means of mounting brackets that are screwed or otherwise fastened to structural elements of the window, window frame or of the wall or ceiling adjacent to the window frame. It is in most cases desirable to mount the brackets such that the roller shade is positioned as close as possible (or practical) to the window in order to minimize the amount of light infiltration between the edges of the shade and the wall or window frame to which it is mounted. However, care must also be taken to allow for sufficient spacing between the roller and the window to permit the fabric or material to be wound and unwound upon the roller tube without binding upon either the wall, ceiling, window frame or glass.

When mounting a roller blind or shade it is also important that the blind be level or horizontal for not only obvious aesthetic purposes, but also to ensure a proper functioning of the blind. If the roller tube upon which the shade is wound is not horizontal, the blind with tend to "telescope" on the roller as it is wound up. Excessive telescoping can cause the edge of the blind to come into contact with the mounting brackets, which can result in damage to the shade material or a binding of the roller tube to the point that it will not function properly.

It will thus be appreciated that careful and time consuming measurements are often required in order to properly mount a blind or shade. The degree of difficulty in mounting the brackets to hold the shade increases in situations where the existing window, window frame, wall and/or ceiling is not perfectly straight or perfectly plumb.

To assist in the mounting of roller shades or blinds, others have suggested the use of adjustable mounting brackets that allow for a degree of vertical movement of the ends of the brackets in order to assist in the horizontal leveling of the roller tube (see for example U.S. Pat. No. 7,854,419, incorporated herein by reference). While such adjustable mounting brackets can be of assistance in horizontally leveling the roller shade, they only provide a vertical adjustment and provide no assistance in terms of a horizontal adjustment to enable an installer to "square" the blind or shade with the wall or window in a horizontal plane.

Standard and currently existing mounting brackets are generally designed for attachment to either vertical surfaces (for example, walls or vertical members of a window frame) or to horizontal surfaces (for example, ceilings, bulkheads or horizontal members of a window frame). However, where the mounting brackets provide for vertical adjustment to assist in horizontally leveling the shade, wall and ceiling mounting brackets are not interchangeable. In that regard, wall brackets include a mounting flange that is positioned perpendicular to the direction of adjustment (ie the mounting flange is horizontal and the direction of adjustment is vertical). In the case of ceiling mount brackets the mounting flange is in the same plane and the direction of adjustment (ie. both are in a vertical plane). It thus becomes necessary for manufacturers to produce both wall mount and ceiling mount brackets. Installers are also required to have on hand both types of brackets, which represents an increase in the cost of the installer's inventory.

There is therefore a need for an improved adjustable roller shade bracket.

SUMMARY

The invention therefore provides an improved roller shade bracket that addresses some of the deficiencies in the prior art.

In one of its aspects the invention provides an adjustable roller shade bracket comprising a first plate, a second plate and a bracket member, said bracket member adapted for mounting to a surface, said second plate rotationally secured to said bracket member, said first plate releasably securable to an end of a roller tube of a roller shade and slidably secured to said second plate such that said first plate may be slid along said second plate in a first plane, rotation of said second plate about said bracket member through 90 degrees permitting said first plate to be slid along said second plate in a plane perpendicular to said first plate.

In a further aspect the invention concerns an adjustable roller shade bracket comprising a first plate, a second plate and a bracket member, said bracket member adapted for mounting to a horizontal or a vertical surface, said second plate rotationally secured to said bracket member, said first plate releasably securable to an end of a roller tube of a roller shade and slidably secured to said second plate such that said first plate may be slid along said second plate in a first plane, rotation of said second plate about said bracket member through 90 degrees permitting said first plate to be slid along said second plate in a plane perpendicular to said first plane, thereby permitting said bracket member to be adaptable between wall and ceiling mount use.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. However, the specification and drawings that follow describe and disclose only some of the specific forms of the invention and are not intended to limit the scope of the invention as defined in the claims that follow herein.

Figure 1:
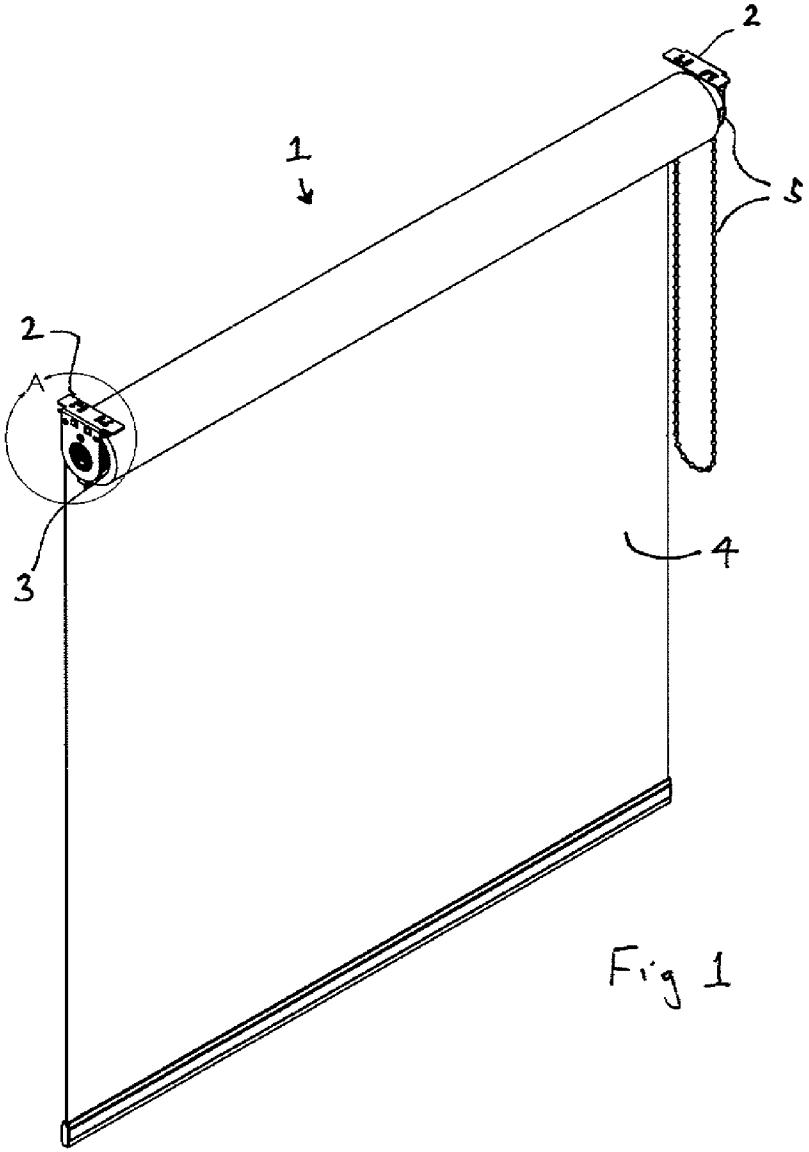
FIG. 1 is a front elevational perspective view of a roller shade or blind employing an adjustable bracket, shown in a ceiling mount configuration, in accordance an embodiment of the present invention.
Figure 2:
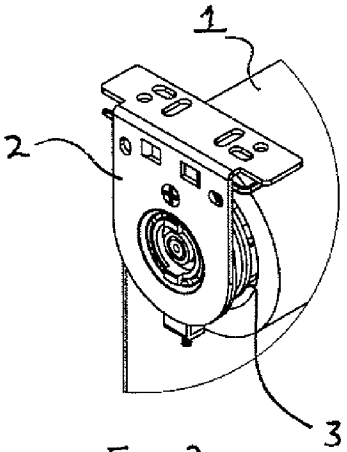
FIG. 2 is an enlarged detail of portion "A" of FIG. 1.
Figure 3:
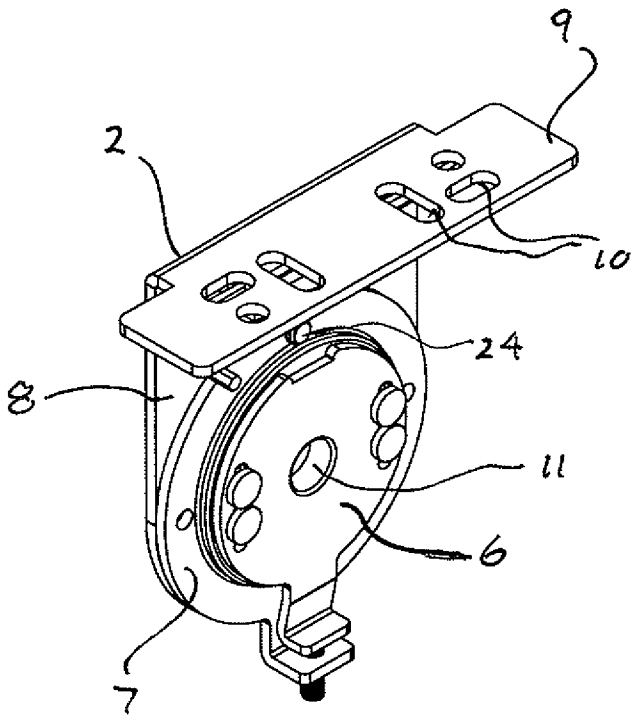
FIG. 3 is an upper right side perspective view of the adjustable roller shade bracket shown in FIG. 1.
Figure 4:
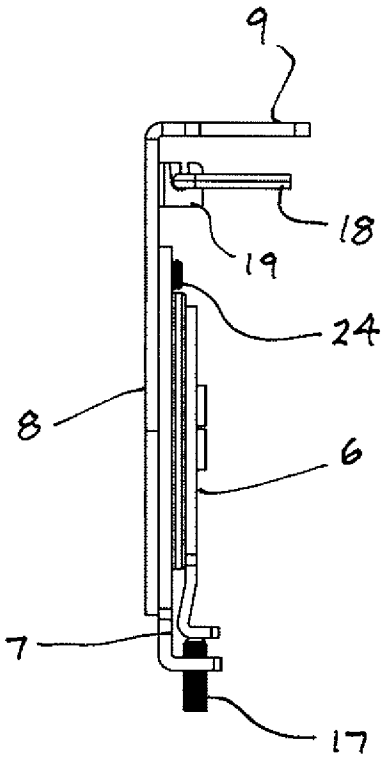
FIG. 4 is a front view of the adjustable roller shade bracket shown in FIG. 1.
Figure 7:
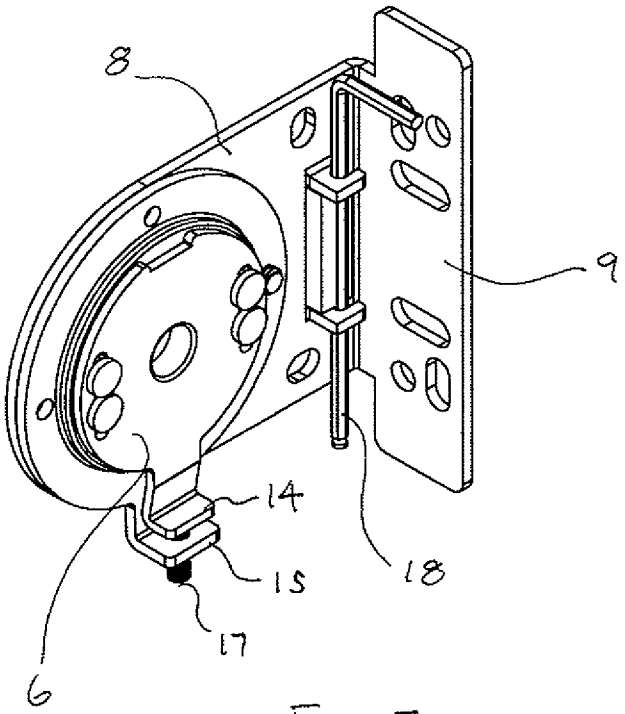
FIG. 7 is a right side perspective view of an adjustable roller shade bracket in accordance with an embodiment of the present invention shown in a wall mount configuration.
Figure 8:
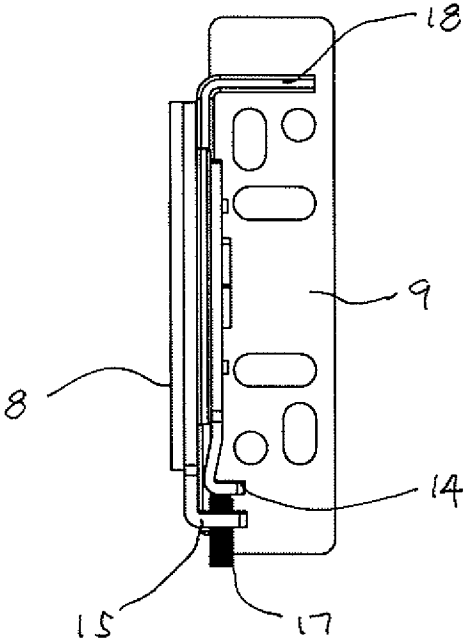
FIG. 8 is a front view of the bracket shown in FIG. 7.
Figure 9:
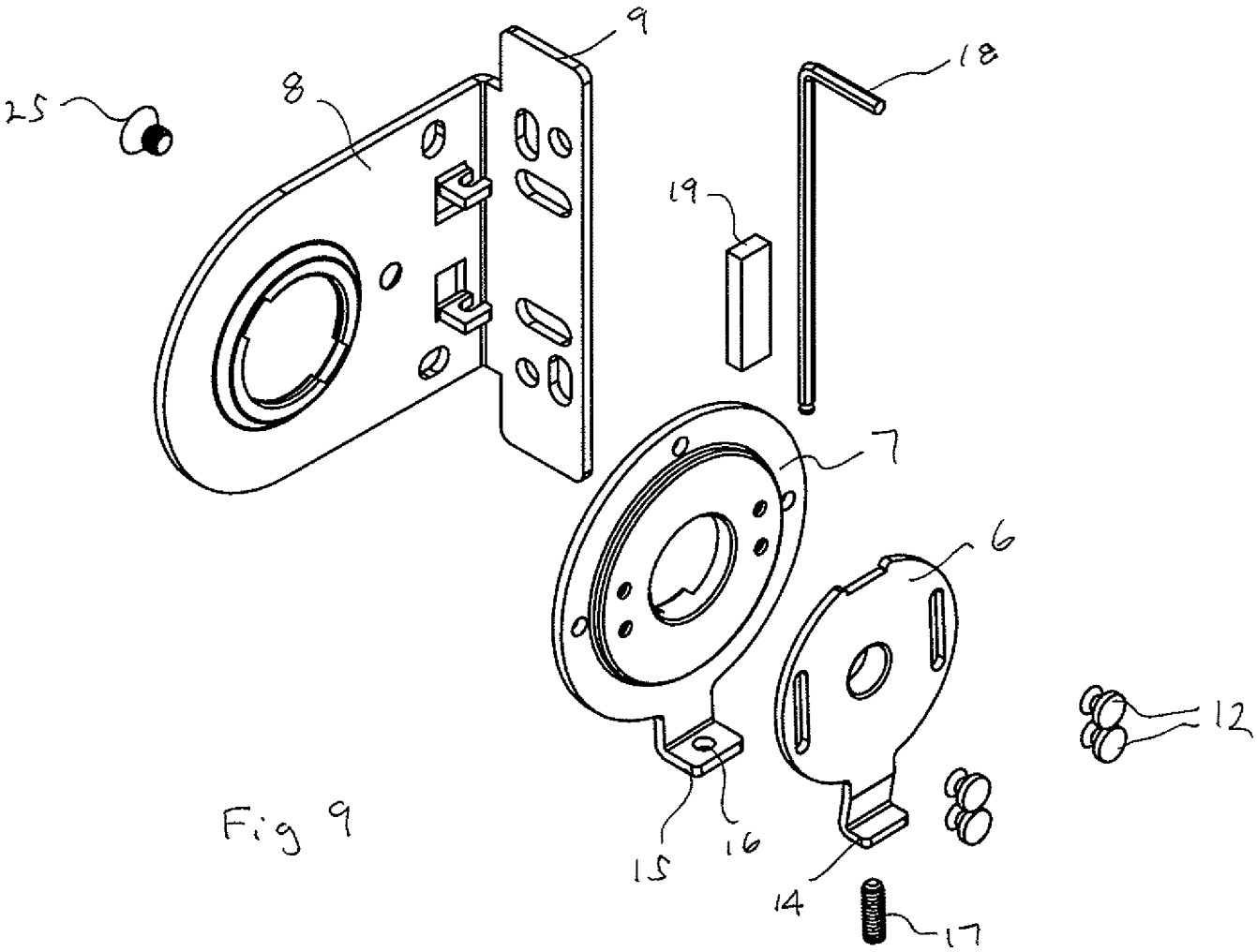
FIG. 9 is a right side perspective exploded view of the bracket shown in FIG. 7.

In the enclosed drawings FIG. 1 shows a typical roller shade or roller blind assembly 1 that is comprised generally of a pair of mounting brackets 2, a roller tube 3, shade fabric 4 and a chain and clutch assembly 5. As the general structure of a roller shade or blind will be readily understood by one of ordinary skill in the art, the details of such are not discussed further herein. The current invention lies in the structure and function of mounting brackets 2, which in this instance are adjustable mounting brackets. It will be equally appreciated by those skilled in the art that brackets 2 may in some cases be mounted vertically (i.e. in a ceiling, bulkhead or the upper surface of a window frame) or may be wall mounted (i.e. to a wall, window trim or window frame). In the enclosed drawings, FIGS. 1 through 6 pertain to a ceiling mount configuration of mounting bracket 2, whereas FIGS. 7 through 9 pertain to a wall mount configuration of mounting brackets 2.

With particular reference to FIGS. 3 through 6, mounting bracket 2 is comprised generally of a first plate 6, a second plate 7 and a bracket member 8. Bracket member 8 is adapted for mounting to a surface (in this instance a ceiling, bulkhead or the upper surface of the window frame). In the embodiment of the invention shown, bracket member 8 includes a flange 9 containing a series of holes or apertures 10 through which screws or other fasteners can be inserted in order to secure the bracket in place. Bracket member 8 is further configured such that second plate 7 can be rotationally secured thereto, allowing for the independent rotational movement of second plate 7 relative to bracket number 8. As will be described in more detail below, first plate 6 is slideably received and secured to second plate 7 such that the first plate may be slid along the exterior surface of the second plate in a first plane which, in the embodiment shown in FIGS. 3 through 6, is a generally vertical plane.

First plate 6 further includes an aperture for accepting the end fitting of a roller tube such that the end fitting may be inserted into the aperture, thereby suspending the roller tube from first plate 6 and hence mounting bracket 2. The nature and configuration of aperture 11 can vary in terms of its size and physical configuration depending upon the nature of the end fitting of the roller tube that it is designed to accommodate. Further, in some instances a bearing or bushing may be inserted into aperture 11 to assist in the rotation of the roller tube.

In one embodiment, first plate 6 is slideably secured to second plate 7 through the use of two pairs of fasteners 12 that extend through elongate slots 13 formed within the first plate. Fasteners 12 may be rivets, screws, bolts or other similar types of fasteners that extend through slots 13 into second plate 7 to hold the two plates together, while at the same time permitting a slideable movement of the first plate along the outer surface of the second plate until such time as the fasteners "bottom out" in their respective slots.

To permit an adjustment of the relative position of the first plate 6 with respect to second plate 7, each of the first and second plates have formed thereon cooperating flanges 14 and 15. At least one of those flanges contains a threaded bore 16 to receive a jack screw 17. In the case of the embodiment shown, flange 15 on second plate 7 contains a bore 16 through which jack screw 17 is threaded. As shown most clearly in FIGS. 3 and 4, flanges 14 and 15 are aligned such that threading jack screw 17 into bore 16 results in it coming into contact with the outer surface of flange 14 on first plate 6. The continued threading of the jack screw into bore 16 forces first plate 6 to slide (in this embodiment in a generally upward direction) along the outer face of second plate 7. Similarly, as the jack screw is turned in an opposite direction and threaded outwardly and through bore 16, first plate 6 will tend (in this particular embodiment) to slide in a generally downwardly direction relative to second plate 7. It will thus be appreciated that through the operation of jack screw 17 there is provided a mechanism to move first plate 6 in a first plane (in this instance vertical), thereby permitting an adjustment in terms of the relative position of the end of roller tube 3. Jack screw 17 may be any one of a wide variety of different currently available screws or bolts. In one embodiment, the jack screw may have an opening for the receipt of an Allen key 18 that can be secured to mounting bracket 2 by means of a clip 19, such that it is readily available for use by an installer wishing to adjust the position of roller tube 3.

It will be further understood from a thorough understanding of the above described structure that the slidable movement of first plate 6 along the face of second plate 7 permits an adjustment of roller tube 3 relative to mounting bracket 2 in a first plane. As will be described below, the rotational engagement of second plate 7 to bracket member 8, and in particular the ability of the second plate to rotate through an angle of 90 degrees relative to the bracket member, permits an adjustment of the roller tube relative to the mounting bracket in a second plane that is perpendicular to the first plane.

Figure 5:
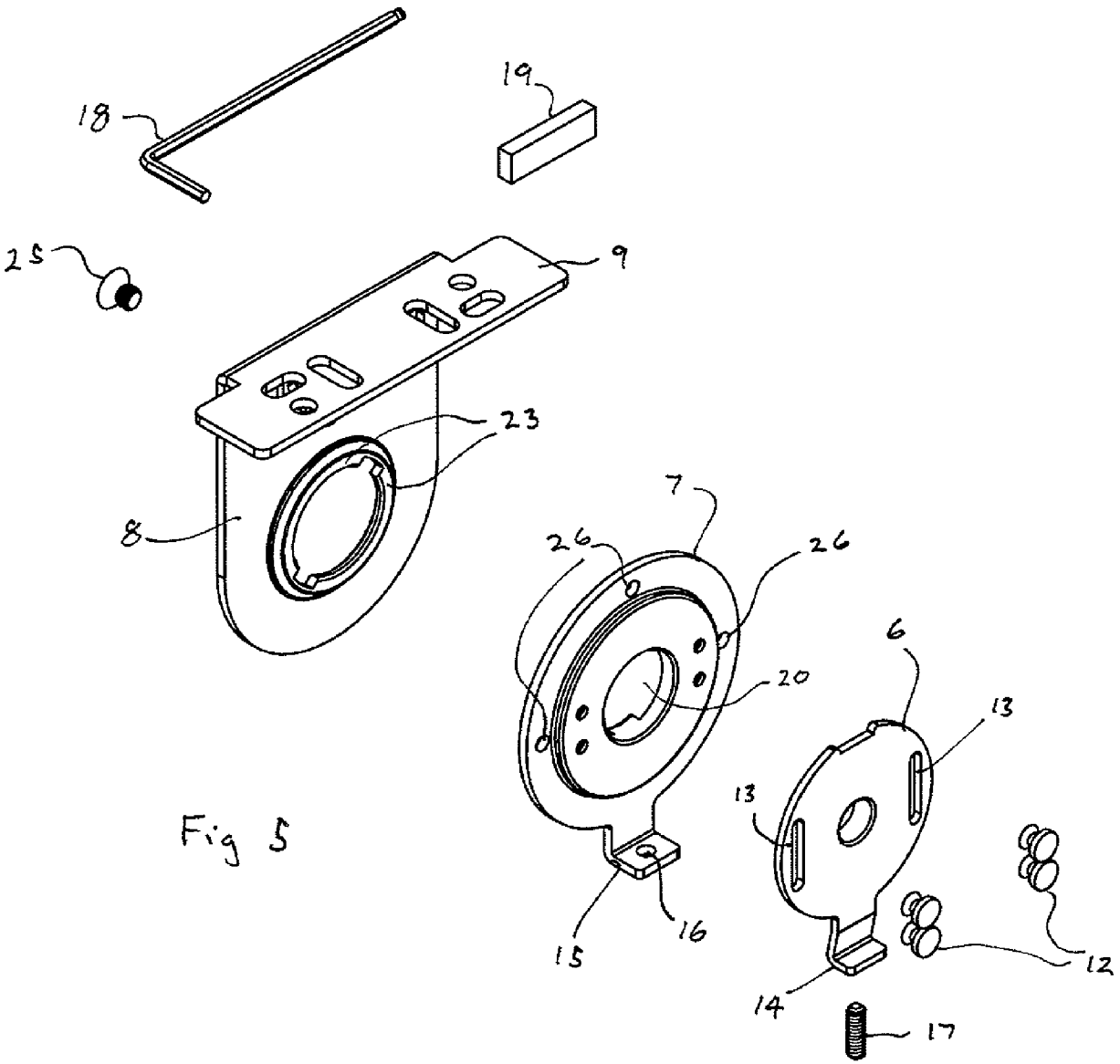
FIG. 5 is a right side exploded perspective view of the adjustable roller shade bracket shown in FIG. 3.
Figure 6:
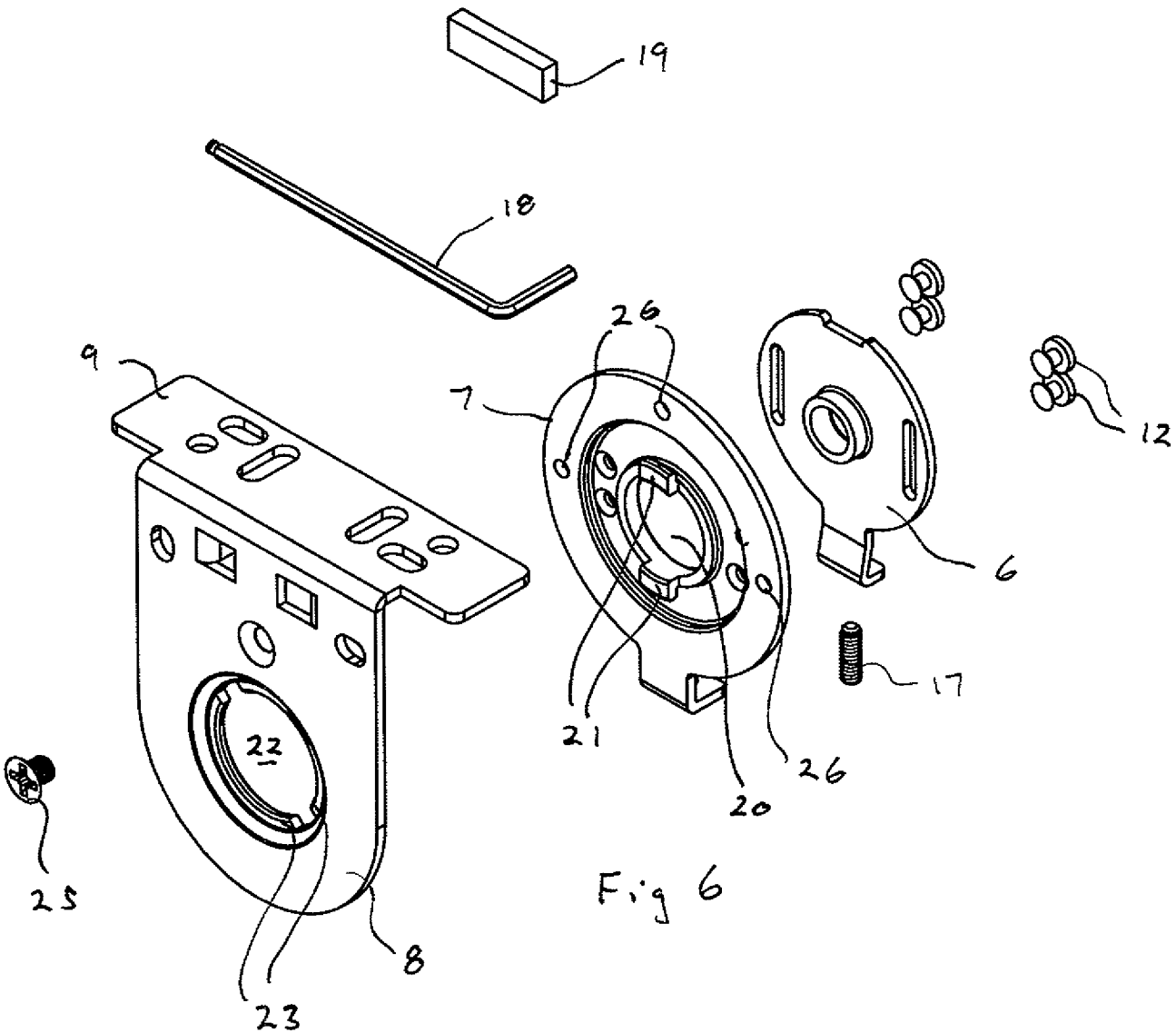
FIG. 6 is a left side exploded perspective view of the adjustable roller shade bracket shown in FIG. 3.

Referring specifically to FIGS. 5 and 6, second plate 7 includes a centrally located bore 20 having extending inwardly therefrom a pair of tabs 21. Bore 20 aligns generally with a correspondingly dimensioned bore 22 on bracket member 8 such that when second plate 7 is rotationally secured to bracket member 8, tabs 21 are received over correspondingly configured flanges 23 within bore 22. In this manner, second plate 7 is securely held against bracket member 8, while still permitting the second plate to rotate relative to the bracket member.

In one of the preferred embodiments of the invention there is further included a locking means 24 to secure the position of second plate 7 relative to bracket member 8. It will be appreciated by those of ordinary skill in the art that locking means 24 may be any one of any wide variety of structures that include bolts, screws, ball springs or indexing members. Locking means 24 could also comprise a ratcheting means positioned between second plate 7 and bracket member 8 that permits the controlled rotational movement of the second plate relative to the bracket member. Regardless of its nature, locking means 24 permits the second plate to be rotated and to be secured to the bracket member, at 90 degree increments from vertical. In so doing, the locking means will essentially be indexed to permit second plate 7 to be rotated and secured relative to bracket member 8 with first plate 6 positioned in such a manner that slots 13 will be either in a generally horizontal or generally vertical configuration. That is, with the operation of locking means 24, second plate 7 can be rotated in 90 degree increments to permit first plate 6 to be slid along the face of second plate 7 either vertically or horizontally. In the embodiment shown in FIGS. 4, 5 and 6, locking means 24 comprises a screw 25 that is received through bracket member 8 and threaded into one of a plurality of holes 26 within second plate 7. To permit the second plate to be indexed at 90 degree relative to bracket member 8, at least one of the holes 26 is preferably situated in a fashion that allows first plate 6 to slide in a vertical plane (in the embodiment shown in FIGS. 5 and 6). Two additional holes 26 are preferably formed within second plate 7 at 90 degree clockwise and 90 degree counterclockwise directions. In this manner screw 25 and holes 26 will permit second plate 7 to be locked or secured in place once rotated 90 degrees in either a clockwise or counterclockwise direction.

The structure of mounting bracket 2 uniquely permits the bracket to be adapted so that it can be configured as a wall mount bracket (i.e. to be mounted to a vertical surface) or as a ceiling mount (i.e. to be mounted to a horizontal surface) while maintaining the ability to horizontally adjust the ends of the roller tube. Conversion between a wall mount and a ceiling mount configuration merely requires the rotation of second plate 7 through 90 degrees in order to allow flange 9 of bracket member 8 to be aligned with the surface to which it is to be secured, all the while allowing first plate 6 to remain adjustable in a vertical plane. In this manner a single bracket can be wall or ceiling mounted and the roller shade can still be adjusted or leveled horizontally once the bracket has been installed. Thus, the described structure provides a single mounting bracket 2 that can be quickly, easily, and without the use of anything more than simple hand tools, converted from a wall to a ceiling mount configuration (and vice versa). Further, it will also be appreciated that, if desired, the unique structure of mounting bracket 2 will allow first plate 6 to be configured such that it is slidable along the face of second plate 7 in a horizontal direction, which will then enable an adjustment with respect to the distance between the end of the roller shade and the window glass, window frame or wall about which it is mounted.

It should be understood that what has been described are the preferred embodiments of the invention and that it may be possible to make variations to these embodiments while staying within the broad scope of the invention. Some of these variations have been discussed while others will be readily apparent to those skilled in the art.

We claim:

1. An adjustable roller shade bracket comprising a first plate, a second plate and a bracket member, said bracket member adapted for mounting to a surface, said second plate rotationally secured to said bracket member, said first plate releasably securable to an end of a roller tube of a roller shade and slidably secured to said second plate such that said first plate may be slid along said second plate in a first plane, rotation of said second plate about said bracket member through 90 degrees permitting said first plate to be slid along said second plate in a plane perpendicular to said first plane, said first and said second plates have cooperating flanges, at least one of said flanges having a threaded bore for receiving a jack screw, when threaded into said bore on one of said flanges said jack screw bearing against said other of said flanges such that rotation of said jack screw results in said first plate slidingly moving along said second plate.

2. The adjustable roller shade bracket as claimed in claim 1 including a locking means to secure the position of said second plate relative to said bracket member.

3. The adjustable roller shade bracket as claimed in claim 2 wherein said locking means permits said second plate to be rotated and secured to said bracket member at 90 degree increments.

4. The adjustable roller shade bracket as claimed in claim 2 wherein said bracket member includes a flange, said flange mountable to a vertical or horizontal surface, said bracket adaptable for wall or ceiling mount use.

5. The adjustable roller shade bracket as claimed in claim 4 wherein said locking means is indexed to permit said second plate to be secured to said bracket member in an orientation that permits said first plate to be slid along said second plate in either a vertical or horizontal plane.

6. The adjustable roller shade bracket as claimed in claim 1 wherein said first plane is either horizontal or vertical.

7. An adjustable roller shade bracket comprising a first plate, a second plate and a bracket member, said bracket member adapted for mounting to a horizontal or a vertical surface, said second plate rotationally secured to said bracket member, said first plate releasably securable to an end of a roller tube of a roller shade and slidably secured to said second plate such that said first plate may be slid along said second plate in a first plane, rotation of said second plate about said bracket member through 90 degrees permitting said first plate to be slid along said second plate in a plane perpendicular to said first plane, thereby permitting said bracket member to be adaptable between wall and ceiling mount use, said first and said second plates have cooperating flanges, at least one of said flanges having a threaded bore for receiving a jack screw, when threaded into said bore on one of said flanges said jack screw bearing against said other of said flanges such that rotation of said jack screw results in said first plate slidingly moving along said second plate.

* * * * *